US009539489B2

(12) United States Patent
Burns et al.

(10) Patent No.: US 9,539,489 B2
(45) Date of Patent: Jan. 10, 2017

(54) SUMMER STYLE WHEELED SKI

(71) Applicant: Lafayette College, Easton, PA (US)

(72) Inventors: John Burns, Chatham, NJ (US); Patrick Reilly, Norwalk, CT (US); Peter Hauke, Shelburne, VT (US); Daniel DeSena, Natick, MA (US); John Floyd, New York, NY (US); Keaton Holappa, Hamilton, MA (US); Matt Smith, Utica, NY (US)

(73) Assignee: Lafayette College, Easton, PA (US)

( * ) Notice: Subject to any disclaimer, the term of this patent is extended or adjusted under 35 U.S.C. 154(b) by 0 days.

(21) Appl. No.: 14/977,159

(22) Filed: Dec. 21, 2015

(65) Prior Publication Data

US 2016/0175692 A1 Jun. 23, 2016

Related U.S. Application Data

(60) Provisional application No. 62/094,357, filed on Dec. 19, 2014.

(51) Int. Cl.

| | |
|---|---|
| ***A63C 17/06*** | (2006.01) |
| ***A63C 17/04*** | (2006.01) |
| ***A63C 17/00*** | (2006.01) |
| ***A63C 17/02*** | (2006.01) |

(52) U.S. Cl.

CPC ..... *A63C 17/045* (2013.01); *A63C 17/006* (2013.01); *A63C 17/0033* (2013.01); *A63C 17/0093* (2013.01); *A63C 17/02* (2013.01)

(58) Field of Classification Search

CPC ..... A63C 17/04; A63C 17/045; A63C 17/06; A63C 17/0033; A63C 17/006

See application file for complete search history.

(56) References Cited

U.S. PATENT DOCUMENTS

| | | | | | |
|---|---|---|---|---|---|
| 1,778,850 | A | * | 10/1930 | Duisenberg | A63C 17/08 280/11.222 |
| 2,430,037 | A | * | 11/1947 | Vincent | A63C 17/04 280/11.209 |
| 3,399,904 | A | | 9/1968 | Schinke | |
| 3,827,706 | A | | 8/1974 | Milliman | |
| 3,856,321 | A | | 12/1974 | Solymosi | |
| 4,134,598 | A | * | 1/1979 | Urisaka | A63C 5/035 280/11.231 |
| 4,460,187 | A | * | 7/1984 | Shimizu | A63C 5/035 280/11.208 |
| 4,744,576 | A | | 5/1988 | Scollan, Jr. | |
| 4,805,936 | A | * | 2/1989 | Krantz | A63C 17/1409 152/8 |
| 4,886,298 | A | | 12/1989 | Shols | |

(Continued)

FOREIGN PATENT DOCUMENTS

| | | |
|---|---|---|
| WO | 2007085730 A2 | 8/2007 |
| WO | 2012113011 A1 | 8/2012 |

OTHER PUBLICATIONS http://www.nordicskaters.com/alpina/#summer.

(Continued)

*Primary Examiner* — Erez Gurari

(74) *Attorney, Agent, or Firm* — Cozen O'Connor

(57) ABSTRACT

A summer style ski having three different types of wheels aligned to allow the ski to travel on non-snow or ice surfaces and to create the feel of carving or turning on a paved surface.

17 Claims, 10 Drawing Sheets

(56) References Cited

U.S. PATENT DOCUMENTS

| | | | | |
|---|---|---|---|---|
| 5,125,687 | A | 6/1992 | Hwang | |
| 5,160,155 | A * | 11/1992 | Barachet | A63C 17/0033 280/11.209 |
| 5,195,781 | A | 3/1993 | Osawa | |
| 5,286,043 | A * | 2/1994 | Tkaczyk | A63C 17/045 280/11.208 |
| 5,901,981 | A | 5/1999 | Lucht | |
| 5,975,546 | A | 11/1999 | Strand | |
| 6,676,138 | B1 * | 1/2004 | Rosso | A63C 17/045 188/5 |
| 6,988,742 | B2 * | 1/2006 | Jonsson | A63C 17/045 188/161 |
| 7,147,235 | B2 * | 12/2006 | West | A63C 17/013 280/11.19 |
| 7,441,787 | B1 | 10/2008 | Jordan | |
| 7,758,054 | B2 * | 7/2010 | Abel | A63C 17/004 280/11.222 |
| 7,784,833 | B2 * | 8/2010 | Tsuchie | A63C 17/004 280/11.19 |
| 8,251,377 | B2 * | 8/2012 | Green | A63C 17/0086 280/11.231 |
| 8,256,776 | B2 * | 9/2012 | Petell | A63C 17/004 280/11.222 |
| 8,360,475 | B2 * | 1/2013 | Cristiano | A63C 17/004 280/11.19 |
| 8,398,099 | B2 | 3/2013 | Edginton | |
| 8,500,135 | B2 * | 8/2013 | Peruffo | A63C 17/045 280/11.204 |
| 9,010,778 | B1 * | 4/2015 | Burns | A63C 17/0033 280/87.041 |
| 9,056,241 | B2 * | 6/2015 | Green | A63C 17/004 |
| 9,079,096 | B2 * | 7/2015 | Chen | A63C 17/0033 |
| 9,314,687 | B2 * | 4/2016 | Parent | A63C 17/0046 |
| 2012/0126523 | A1 | 5/2012 | Langer | |
| 2013/0175775 | A1 | 7/2013 | Bermal | |

OTHER PUBLICATIONS http://www.oxygenfedsport.com/2011/11/in-us-fischer-rollerskis-would-compete-in-a-small-market.
Grasskiusa.com.
http://www.freebordportugal.com/about/.
http://www.freebordportugal.com/wp-content/uploads/Early-Freebord-Prototypes.jpg.
http://www.woodwardtahoe.com/.
http://www.trekaroo.com/photos/0017/5469/WoodwardTahoe_DrylandSnowboard.JPG.
http://www.roces.com/en-us/products/inlineskates.aspx#133.
http://www.skatesetup.com/Skates/Rollerblade/Non-UFS/Roces-M12-with-big-ass-wheels-2689.
http://09236252andrewogilvie.blogspot.in/.

* cited by examiner

SUMMER STYLE WHEELED SKI

FIELD OF INVENTION

The present application is generally related to wheeled devices, and more particularly to a wheeled device having a general orientation of a ski and comprising wheels oriented to allow for users to have the sensation of skiing on non-ice or snow surfaces.

BACKGROUND OF THE INVENTION

Skiing is a popular winter sport but relies upon the increasingly fickle coverage of snow or ice. Certainly, we are seeing higher than normal temperatures and lower than normal precipitation resulting in smaller snow pack and shorter skiing seasons. Winter skis, of course, have a generally flat base side that is waxed or coated to make it slick and reduce friction, and on each side of the ski is a sharp metal or composite edge to aid in gripping the snow or ice. This edge allows the skis to properly turn, carve, and stop on the snow and ice, and allows a user to traverse down a hill or over flat land, based on using downhill style skis, telemark style skis, or cross country skis.

Skis have changed in shape over the past few decades, and many modern skis utilizes a side cut design, wherein the center of the ski is narrower than the tips of the ski. Furthermore, the skis are shaped so that there is a camber, having a slight upward curve in the middle of the ski. These elements impact how the ski turns and feels. Designs to mimic these features and the feeling of carving are lacking.

Because of the shorter ski seasons and unreliable snow conditions, consumers that enjoy skiing, and resorts that rely on these consumers face a conundrum in that they skiing seasons are short and unpredictable. Once the ice or snow has melted, grass, dirt, and other dry surfaces, make winter style skiing impossible.

To combat this, composite materials have been created that are nearly as slick as the snow or ice, and in certain locations, small amounts of composite materials are laid onto the ground to enable skiers to use conventional or nearly conventional skis in areas that lack in snow. For example, the United States Olympic Training Center in Lake Placid N.Y. has installed a surface of composite materials on the hills below the ski jumping features, to allow ski jumpers to practice jumping when there is no snow or ice on the ground. However, the composite materials are generally expensive and it would be impractical to install such a material over a large portion of ground to enable use of typical winter skis. In other areas, indoor skiing relies upon chilling a large room and creating snow with a snow gun. However, each of these options have significant limitations.

Other methods of skiing without snow or ice have included placing plastic on a slope and using modified skis to slide down the plastic. Similarly, people have employed wood, such as plywood and have further added slick materials such as wax, paints, and oils to the surface to reduce friction. Typically still, these materials still require the use of non-traditional skis to move down the surface.

Several entities have tried to make summer skiing type products that include wheels or high friction materials to aid in sliding down a grass or other hard surface. For example, U.S. Pat. Nos. 3,827,706, 4,134,598, 4,460,187, 4,744,576, 4,886,298, 4,805,936, 5,125,687, 5,195,781, and 5,975,546 have tried to create a roller ski or snowboard but none have found success in the marketplace.

Typical patents have utilized various strategies to provide wheels that face in the direction of movement of the ski, while providing other wheels or mechanisms to allow the ski to "carve" as if on the edges of a typical winter snow ski.

Additional information and products related to summer style skis include: http://www.nordicskater.com/alpina/#summer; http://www.oxygenfedsport.com/2011/11/in-us-fischer-rollerskis-would-compete-in-a-small-market; and Grasskiusa.com.

Despite these prior art examples, no summer style ski has yet found an appropriate design to engage users of winter skiers, as the summer style skis often fail in the feel of sliding and carving that is found on winter skis. The embodiments described herein provide for a summer style ski that simulates sliding and carving movements, utilizes weight distribution and edge engagement to controls speed, and provides a unique summer skiing experience that seeks to more closely mimic winter style skiing.

SUMMARY OF THE INVENTION

An embodiment of the present disclosure comprises a wheeled ski comprising a base, a binding, and three different wheel types, arranged along the length of the ski; wherein the binding is centrally located along the longitudinal axis and the three wheel types have a having a mirror image wheel type on either side of the binding; wherein extending away from the binding along the longitudinal axis in each direction is a pair of fixed wheels having a fixed axle and the wheels extending away from the base along the lateral direction, where the wheels can rotate along a rotational axis and allow the ski to move along the longitudinal axis; extending further to the end of the ski from the fixed wheels are corresponding pairs of moveable axle wheels, having a mount with an axle positioned along the lateral axis and wherein the axle can move horizontally, as compared to the fixed axle wheels which do not move; finally, the outermost wheels are single caster wheels positioned at each end of the ski, and mounted on a Z-shaped mount.

A particular embodiment of the summer style ski comprises a base, a binding, a pair of caster wheels, two pairs of moveable axle wheels, and two pairs of fixed axle wheels each arranged along the longitudinal axis of the base; (a) wherein the base has a length, a width, a left edge, a right edge, a top, a bottom, a front and rear tip, and two cutout portions; (b) wherein connected to each of the front and rear tip is a caster support member that is roughly a Z shaped member, wherein one side of the Z shaped member is connected to a portion of the base at the front and rear tips, and the other end of the Z shaped member is positioned above the base and extends past the tip to be about parallel to the base; the end extending past the tip comprises a pivot member; attached to the pivot member is a caster wheel, which is positioned below the Z shaped member; (c) adjacent to the Z shaped member and positioned towards the center of the base along the longitudinal axis on each end, is a pair of adjustable axle wheels; wherein the adjustable axle is connected to the base and the axle extending along the lateral axis; wherein wheels are attached to each side of the axle and extend beyond the left and right edges of the base; (d) positioned within the two cutout portions of the base are two pairs of fixed axle wheels, wherein the fixed axle is secured to the base and positioned such that the axle is along the lateral axis; wherein the wheels are engaged to the axle and extend to be about even with the left and right edges of the base; and (e) about centrally positioned on the base, and between the fixed axle wheels, is a binding; and (f)

wherein the three different types of wheels have varying vertical clearance with respect to the bottom base; wherein the fixed wheels have the smallest clearance between the bottom of the wheel and the bottom of the base; the adjustable wheels having the next smallest clearance; and the caster wheels on each end having the greatest distance between the bottom of the wheel and the bottom of the base; whereby when the ski is placed on a surface, only the caster wheels are necessarily touching the surface.

A further embodiment of the present disclosure comprises a wheeled ski comprising three types of wheels, a binding, and a base; (a) wherein the first type of wheel is a freely rotating wheel; with one wheel attached to a support member at each end of the longitudinal axis of the base; (b) attached adjacent to the freely rotating wheels on each end are a pair of movable axle wheels, wherein the axle is oriented in the lateral axis and having a rotational axis such that a wheel attached to the axle will propel the ski along the longitudinal axis; (c) attached between the pair of movable axle wheels on each end is a pair of fixed axle wheels, which are mounted closer to the center line of the base than the movable axle wheels, with the axle aligned along the lateral axis; (d) and centrally located is a binding that is situated between the two pairs of fixed axle wheels, and (e) wherein each of the three types of wheels has a different ground clearance, wherein the caster wheels touch the ground first, the adjustable wheels touch the ground next and finally the fixed axle wheels come into contact with the ground upon a force flexing the base and engaging the wheels. The wheel placement with regard to the longitudinal positioning of each of the types of wheels, and the vertical orientation of each of the wheels mimics the camber and side cut of a traditional snow ski.

DETAILED DESCRIPTION OF THE INVENTION

The embodiments of the invention and the various features and advantages thereto are more fully explained with references to the non-limiting embodiments and examples that are described and set forth in the following descriptions of those examples. Descriptions of well-known components and techniques may be omitted to avoid obscuring the invention. The examples used herein are intended merely to facilitate an understanding of ways in which the invention may be practiced and to further enable those skilled in the art to practice the invention. Accordingly, the examples and embodiments set forth herein should not be construed as limiting the scope of the invention, which is defined by the claims.

As used herein, terms such as "a," "an," and "the" include singular and plural referents unless the context clearly demands otherwise.

As used herein, the term "about" means within 10% of a stated number.

The terms "summer ski" and "land ski," are used interchangeably to mean a ski of the present disclosure that does not require snow or ice to move and includes wheels. In comparison a "winter ski" is intended for snow and ice use and does not have wheels, but has a low friction base and edges on each side of the base for turning on the snow or ice surface.

The embodiments described herein pertain to summer skis having a plurality of wheels that are aligned to create a ski that can be used on dry surfaces such as grass, cement, pavement, dirt, etc., and that simulate the sliding and carving movements of a winter ski. The summer ski utilizes weight distribution and edge engagement through the various wheels arranged on the length of the ski to control speed and engage in turning on a surface.

Figure 1:
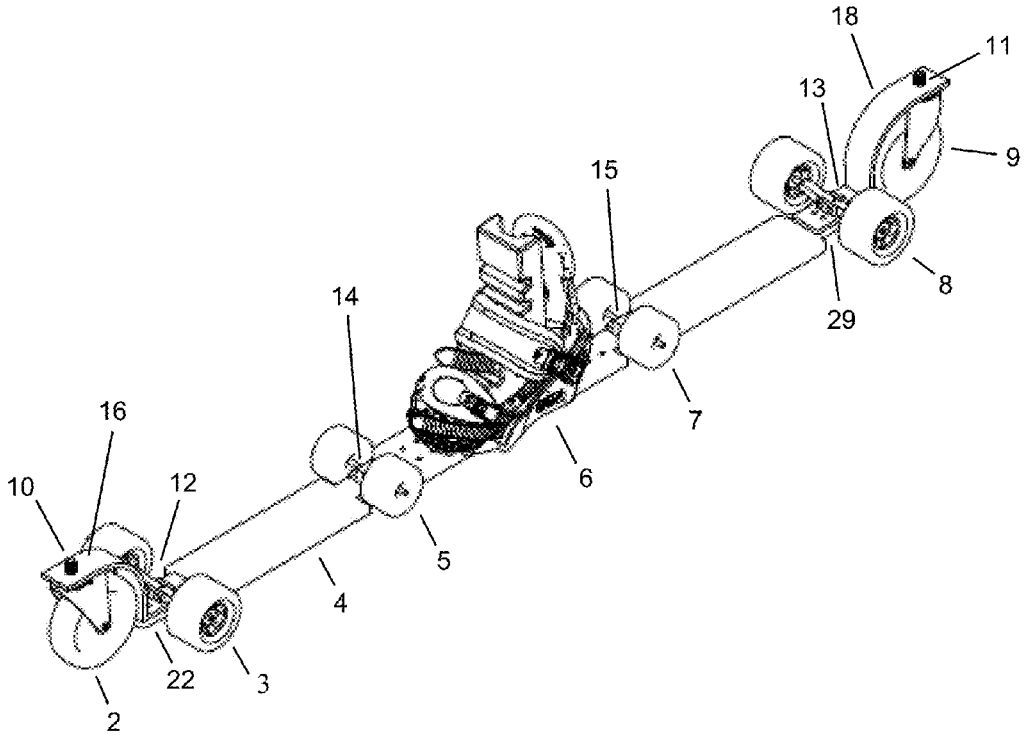
FIG. 1 is a depiction of an embodiment of a summer ski of the present invention.

FIG. 1 provides an overview of the summer ski 1 which includes a front caster wheel 2, a pair of front adjustable wheels 3, a base 4, a pair of front fixed wheels 5, a binding 6, a rear pair of fixed wheels 7, a pair of rear adjustable wheels 8, and a rear caster wheel 9. Each of the caster wheels are supported by an angled mount 16 and 18, which are secured to the base 4 on each end. The front caster wheel 2 is secured to a front caster pivot 10, which is connected to the angled caster mount 16. And the rear caster wheel 9 is secured to a rear caster pivot 11, which is connected to the rear angled caster mount 18. The front adjustable wheels 3 are secured to the base 4 via a mount 22. Similarly the rear adjustable wheels 8 are secure to the base 4 via a rear mount 29. The front fixed wheels are secured to a front fixed axle 14 and the rear fixed wheels 7 attached to a rear fixed axle 15.

As can be seen, the base 4 provides for the main support for the summer ski 1, and the various wheels aligned along the longitudinal axis of the ski. The axles for the adjustable wheels 3 and 8 and their mounts 22 and 29 provide that the axle supporting these wheels is positioned along the lateral axis. The front and rear fixed wheels are secured to the front and rear fixed axles 14 and 15, which too are aligned along the lateral axis. Accordingly, the four axles are positioned so as to be perpendicular to one another, whereby wheels attached to the axles can rotate along a rotational axis to propel the ski generally along the longitudinal axis. However, by imparting forces onto the base 4, and carving, or apply pressure to one side of the ski as compared to another, the base 4, flexes, and the adjustable wheels and the movable axle moves with the force, and the fixed wheels, with the fixed axle, are engaged to the ground. This allows the feel of sliding along the ground similar to that of turning or carving as if on the snow.

Figure 2:
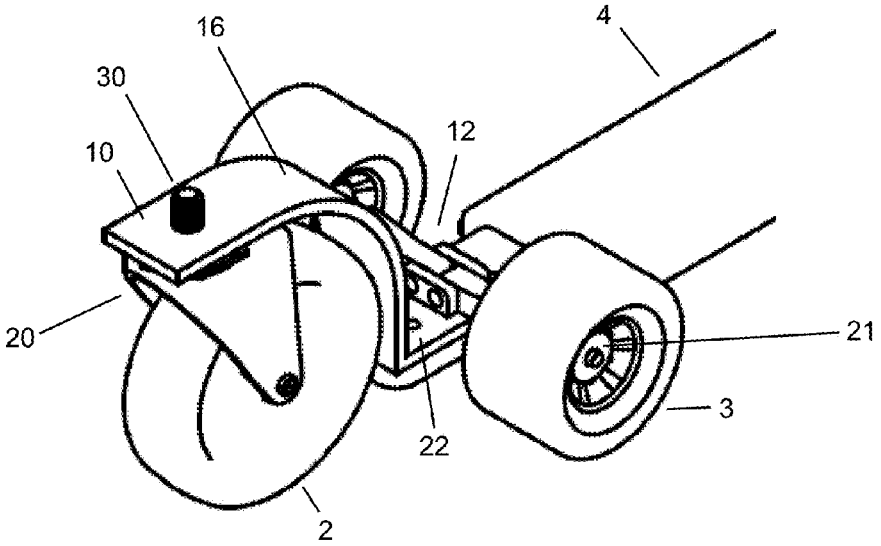
FIG. 2 depicts a front caster and adjustable wheels of an embodiment of the present invention.

FIG. 2 provides a more detailed view of a front portion of a summer ski 1, wherein the front caster wheel 2, is secured to a front caster support 20, which is a U-shaped feature that provides attachment for an axle at the ends of the U-shape, such that the wheel is situated within the U-shaped support 20. This caster support 20 is then secured to the caster mount 16 with a bolt 30, which is further secured to the base 4. Alternative shaped caster supports 20 are suitable as known to one of ordinary skill in the art. The caster mount 16 has a Z shape, with one of the vertices being curved, instead of at a sharp angle. The caster mount 16 has one end attached to the base and the other end extending past the tip of the base, as if it is an extension of the base. This extension, by raising above and extending past the front and rear tip of the base, provides sufficient clearance for the front caster wheel 2 to freely rotate and move without contacting the base 4. Indeed, the caster wheel 2, using the U-shaped support 20 can freely rotate along the axis that is parallel to, or about parallel to the pivot 10.

Situated behind the caster wheel 2 is a pair of adjustable wheels 3. The adjustable wheels can use any of several axle systems to allow for this adjustment including a skateboard style rigid axle connected to a rubber grommet (See FIGS. 11A and 11B), or use an independent suspension style axle as is depicted in FIG. 2, which allows each wheel to adjust independently. The axle (as one or two pieces) 12 is secured to a front adjusting wheel mount 22, which positions the axle along the lateral axis. The adjustable wheels 3 adjust vertically with respect to the ground, and have little lateral travel, i.e. movement towards or away from the base 4. However, when skateboard style trucks and axles are used, some lateral movement is inherent in that design based upon the axle being connected to the truck via a rubber grommet. This allows the wheels, to then rotate about the axle, wherein the wheel rotate along a rotational axis that allows the ski to travel generally in the direction of the longitudinal axis.

Figure 3:
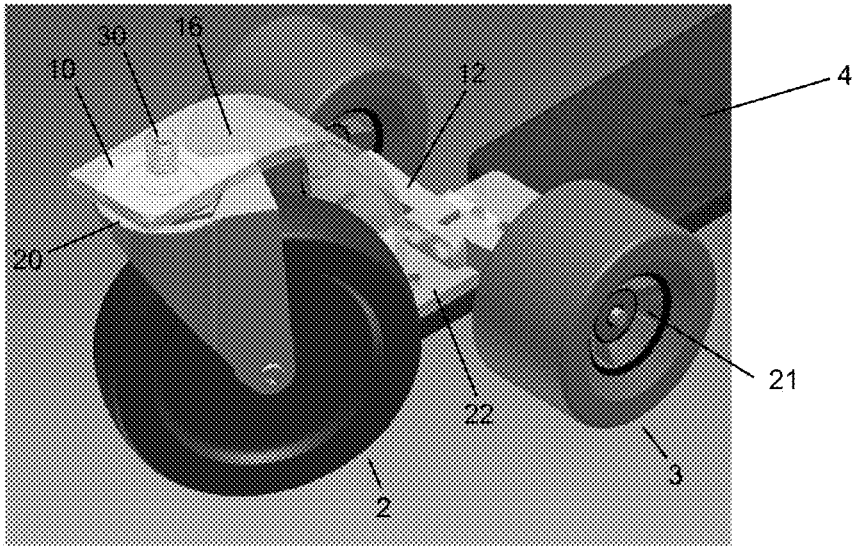
FIG. 3 depicts a different view of the front caster and adjustable wheels of an embodiment of the present invention.

FIG. 3 is nearly identical to FIG. 2 but depicts the front caster wheel 2 as angled. This shows that the entire U shaped support 20 rotates around the pivot 10. The caster wheel 2 can rotate 360° if needed.

Figure 4:
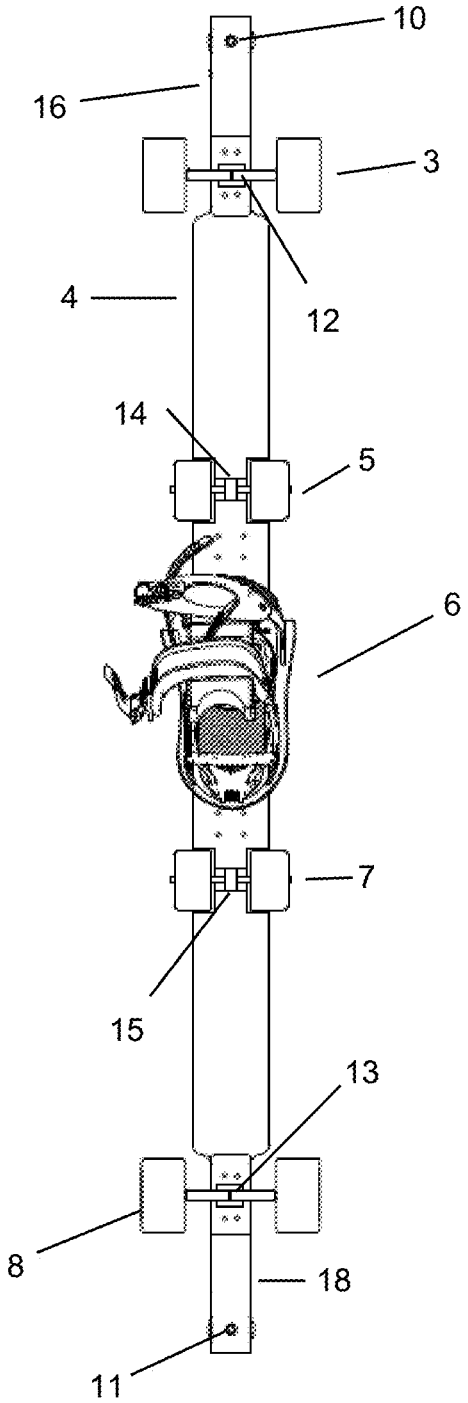
FIG. 4 depicts a top down view of a summer ski of the present invention.

FIG. 4 provides a top down view of the summer ski 1 and provides a view of the extension of the front and rear caster wheels as attached to the front caster mount 16 and rear caster mount 18. The caster wheels 2 and 9 being secured below the pivots 10 and 11 on each end. Moving from the exterior caster wheels 2 and 9, the next wheels, moving along the longitudinal axis towards the central binding from each end, are the adjustable wheels 3 and 8. As can be seen from FIG. 4, these wheels extend the furthest in the lateral sense from the base 4. Indeed, the outboard distance, meaning, the space between the center of the central longitudinal line of the summer ski 1 and the edge of the wheel, of each of the wheel sets is important to the function of the summer ski 1. The caster wheels 2 and 9 are centrally aligned and have no outboard distance. In comparison, the adjustable wheels 3 and 8 have the greatest outboard distance, and the fixed wheels 5 and 7 have a slight outboard distance, being placed just outside the center of the central longitudinal line of the summer ski 1. Also, as is depicted, the axles of the various wheel sets are positioned to be parallel to one another. This allows the wheels to all roll together and allow the ski to generally travel along the longitudinal axis.

Moving more centrally, towards the binding 6, the next sets of wheels are the fixed wheels 5 and 7. As compared to the adjustable wheels 3 and 8, these fixed wheels 5 and 7 also extend away from the base 4, but do not have as great of outboard distance as the adjustable wheels 3 and 8. In view of FIG. 1, it can be seen that a slight cutout portion is in the base 4, thus allowing the fixed wheels to appear to be overlapping with the base 4. Instead, these cut out portions of the base 4, allow the fixed wheels to be close to the central line of the board (as if a line was drawn between the caster wheels on each end). The fixed wheels then only slightly extend past the edge of the base 4, and extend no more than one-half of the width of the wheel beyond the edge of the base. The Adjustable wheels, 3 and 8, extend more than one-half of the wheel width beyond the edge of the base. Indeed, in preferred embodiments, the adjustable wheels are positioned outside of the edge of the base.

Also depicted in FIG. 4 is that at the tip portions of the base, the base has a narrowed portion as compared to the rest of the base. This allows for the movable axle to have additional space to move vertically and also allows the wheels to therefore move with the axle and not contact the base inadvertently when carving the ski.

Figure 5:
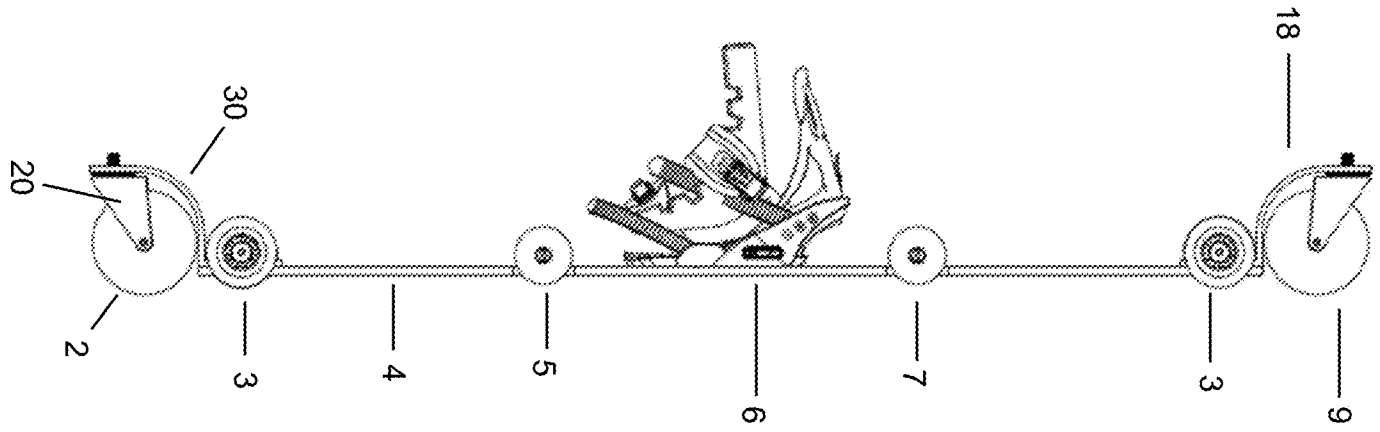
FIG. 5 depicts a side profile view of a summer ski of the present invention.
Figure 6:
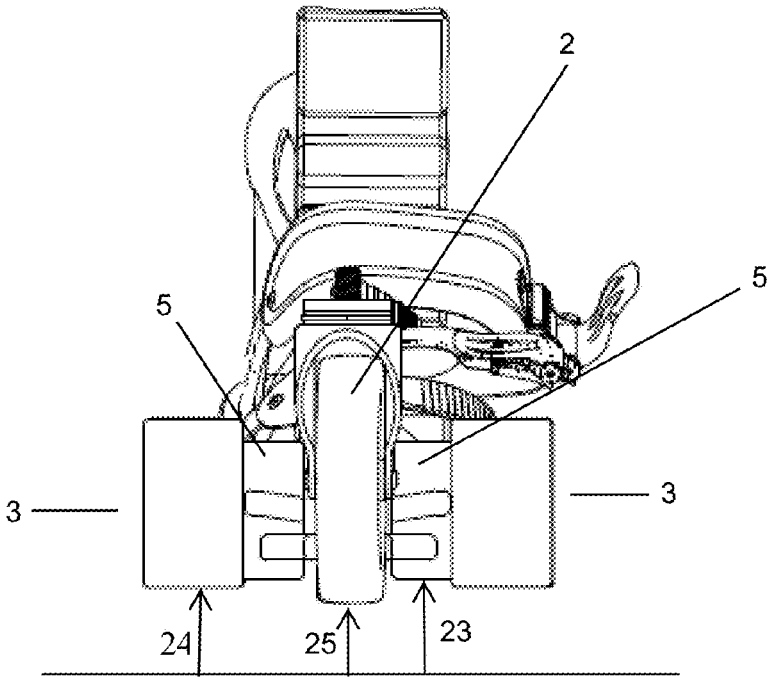
FIG. 6 depicts a front profile view showing the ground clearance of the wheels of an embodiment of the present invention.

FIG. 5 provides further detail into the orientation of each of the wheels and their relative clearance from both the base and what would ultimately be a surface they are placed upon. Indeed, FIG. 6 provides an explicit view of the three different types of wheels and identifies the vertical clearance between the bottom of each wheel and the ground. Indeed vertical clearance between the caster wheel 2 and the ground 23 is the smallest. The vertical clearance 24 between the adjustable wheel 3 and the ground is slightly larger, and the vertical clearance 25 between the fixed wheels and the ground is the largest.

FIG. 6 provides a frontal view of a summer ski 1. As depicted, the vertical clearance of each of the various wheels is clearly identified, with the caster wheel 2 having the lowest vertical clearance and would thus touch the ground first. Therefore, when no weight is placed on the summer ski 1, only the outermost caster wheels 2 and 9 will be touching the ground. Next, the adjustable wheels 3 have the next lowest vertical clearance and touch the ground upon impart of a force from a rider. In particular, the base 4 flexes as a ride's weight is applied, and further flexes as pressure is applied by the rider to the base 4, such as when the rider seeks to turn or impart pressure on the base 4. This applied pressure first causes at least one adjustable wheel 3, on the side of the pressure being applied, to contact the ground. For example, a rider, facing downhill and applying pressure to turn left, would force the left adjustable wheels 3 and 8 to contact the ground. Subsequently, and with the impart of sufficient force, the fixed wheels 5 and 7 would engage and contact the ground. By providing such force as each set of wheels contact the ground, reactionary forces are applied and provide forces to the summer ski 1. The sequential application of reactionary forces due to the wheels variable placement, in both vertical clearance and in outboard distance from the centerline, mimics the sidecut of a ski (the curvature in the edge of a winter ski, wherein the middle of the ski is narrower than the ends), as well as camber (the slight upward curve in the middle of a winter ski.

A typical rider often provides pressure through inclination or tipping of the ski to set an edge. This provides that the base 4 of the summer ski 1 is not parallel to the ground, but at an angle, and thus engages first the wheels on one side of the base, that is angled towards the ground. The adjustable wheels 3 and 8 engage first, creating a turning radius, and allows the rider to turn the ski. Additional pressure then can engage the fixed wheels 5 and 7, and achieves a tighter turning radius. Such radius and ability to turn is further achieved through the flexibility of the base in connection with the vertical displacement and the outboard displacement of the various wheel sets.

As is quite common, by increasing the speed of the rider, the summer ski operates more efficiently, due to increased balance and stability. Additionally at higher speeds, the rider has a greater ability to provide pressure to the skis.

Therefore, upon a mass being placed on the summer ski 1, the caster wheels 2 and 9 will contact the ground. Upon a sufficient mass or force, the adjustable wheels 3 and 8 will contact the ground. The adjustable wheels 3 and 8 imitate the ski edges at the tip or tail of a traditional winter ski. The adjustable wheels 3 and 8 rotate only in the direction of the ski and allow the skier to turn or carve the ski, much like a traditional winter ski. These adjustable wheels 3 and 8 provide further resistance to sliding motion and are particularly engaged during turning and stopping.

Turning to the innermost fixed wheels 5 and 7, under most circumstances the fixed wheels 5 and 7 will not touch the ground until a significant lateral force is applied by the user to turn or create and edge, as if skiing on winter skis or carving a skateboard. Accordingly, the fixed wheels 5 and 7 will then contact the ground and are engaged only during this hard carving, turning, or stopping. These fixed wheels 5 and 7 imitate the ski edges of a winter ski underfoot. The fixed wheels 5 and 7 rotate only in the direction of the centerline of the ski, whereas the caster wheels 2 and 9 can rotate and move in any direction, regardless of the position of the ski.

Figure 7:
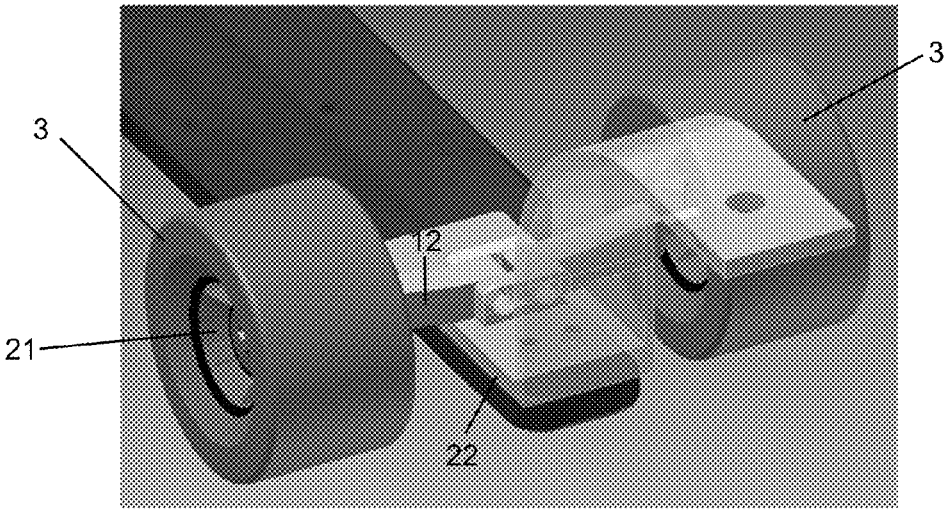
FIG. 7 depicts a pair of front adjustable wheels of an embodiment of the present invention.
Figure 8:
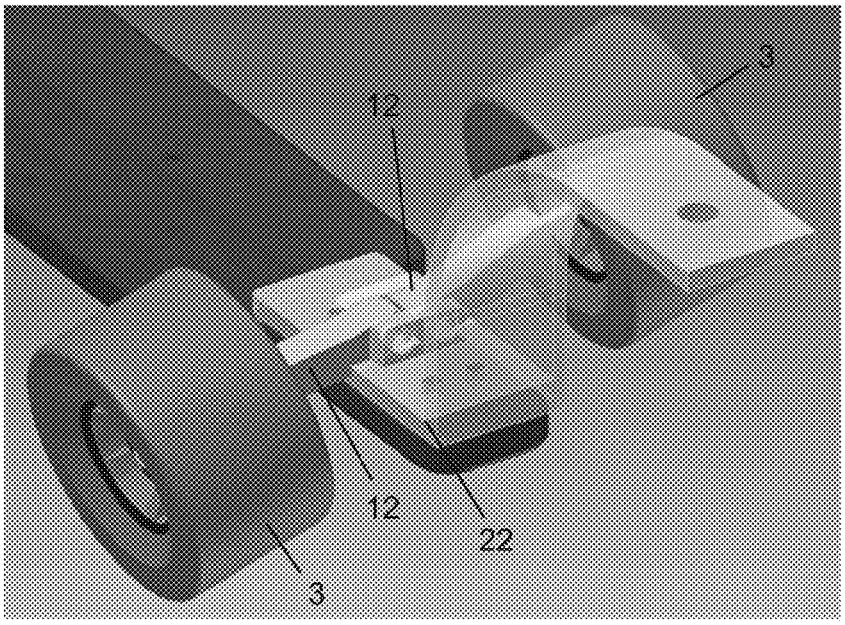
FIG. 8 depicts a pair of front adjustable wheels of an embodiment of the present invention.

FIGS. 7 and 8 provide greater detail with regard to the movement of the adjustable wheels 3 and 8. FIG. 7 depicts the wheel in a position where the axle is at a nearly parallel level to the ground. In comparison in FIG. 8, the wheel on the right is significantly raised, and the axle 12 is no longer parallel to the ground and the base 4. Accordingly, the wheel positioned on the right side of the image is engaging a surface and thus the axle and wheel has moved from its resting place.

Figure 9:
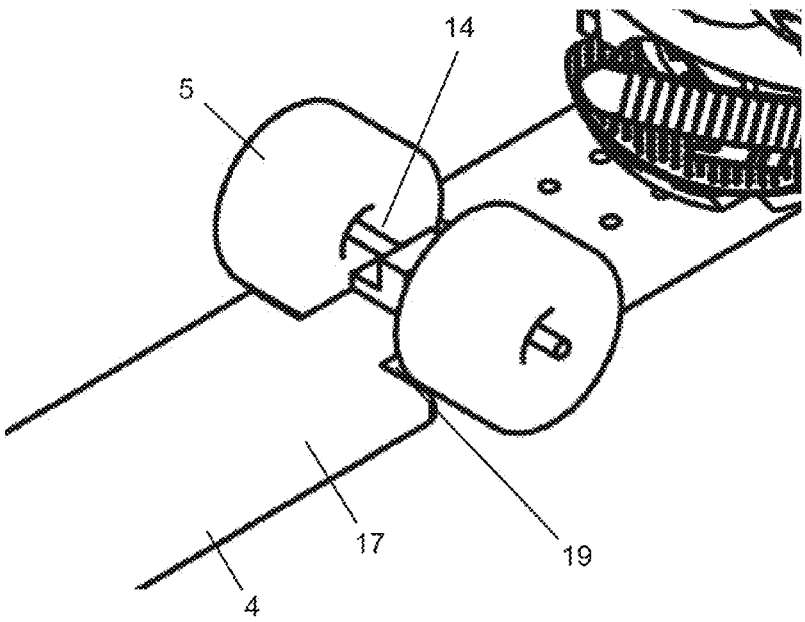
FIG. 9 depicts a pair of fixed wheels of an embodiment of the present invention.

FIG. 9 provides a detail of the fixed wheel pair 5, wherein the fixed wheel has an axle 14, and a fixed axle support 17 to secure the axle 14 to the base 4. As can be seen the cutout base 19 portion of the base 4 allows the fixed wheels to be centrally aligned along the central axis of the ski, and to minimize the ground clearance as depicted in FIGS. 5 and 6. The location of the cutout base 19 portion is positioned between the adjustable wheels 3 and 8, and in preferred embodiments, is located to be overlapping with the binding. In some embodiments the cutout base 19 portion may be within about 1 to about 24 inches from the bindings.

Figure 10:
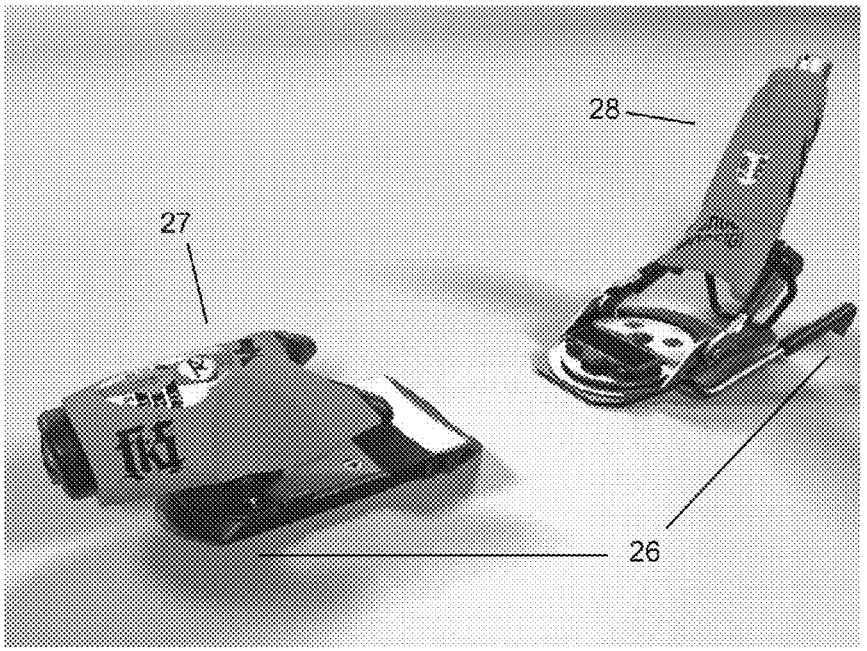
FIG. 10 depicts a binding element to be used in conjunction with the summer ski as described in the present disclosure.

FIG. 10 provides an example of one of several binding pairs 26, including a toe portion 27 and a heal portion 28. This is similar to a typical winter ski binding. In comparison, the bindings 6 depicted in, for example, FIGS. 1 and 4, are more similar to a snowboard style binding. Both of the binding styles can be incorporated and utilized with the summer ski 1 as described in the various embodiments.

Figure 11A:
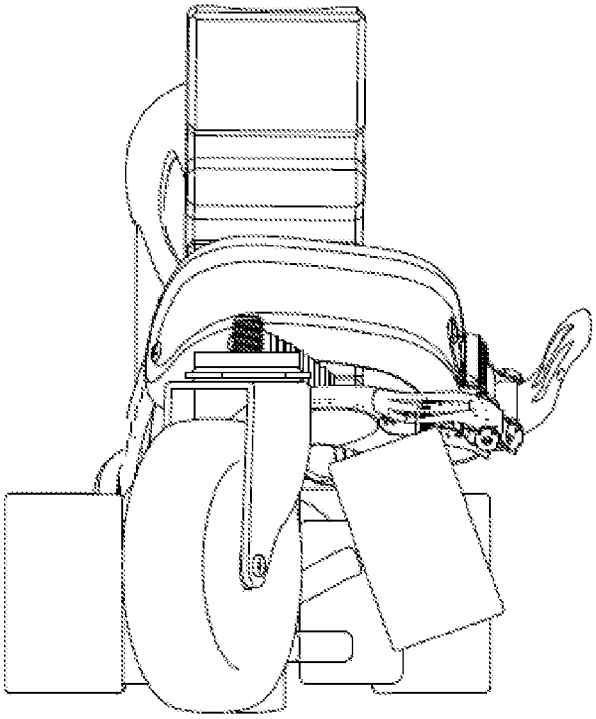
FIGS. 11A and 11B depict embodiments using a fixed axle and an adjustable axle for the front wheels.
Figure 11B:
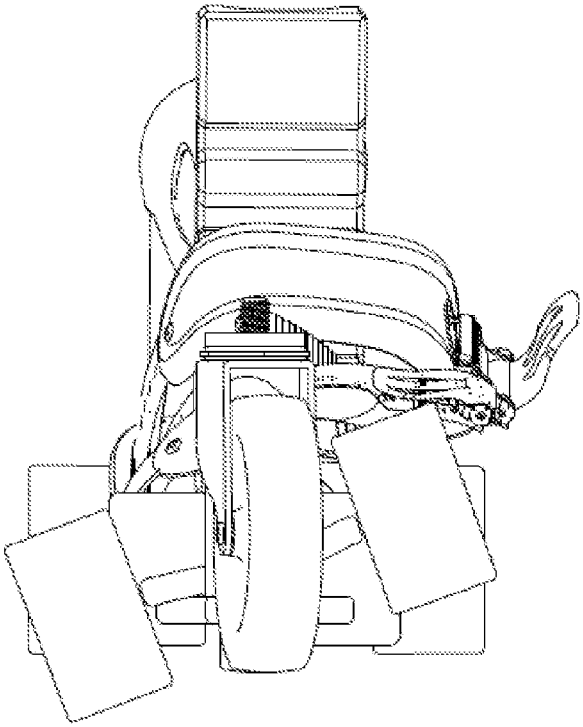
Figure 12:
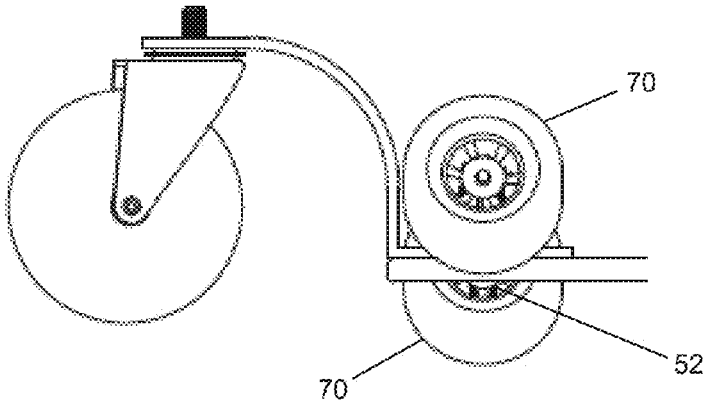
FIG. 12 depicts an embodiment having a fixed axle.

FIGS. 11A and 11B depict the summer style ski having two different embodiments of adjustable wheels 3. Indeed, FIG. 11A depicts an adjustable wheel 3 having an axle 12 that is independent of the wheel on the opposing lateral side. Accordingly the pair of wheels 3, in FIG. 11A use independent suspension to allow for each lateral side to move independently. In comparison, FIG. 11B utilizes a fixed axle 52, wherein the pair of wheels 70 must move together on the fixed axle. A non-limiting example of a fixed axle is a skateboard truck. In certain embodiments the independent suspension axle 12 is preferred over the fixed axle 52. FIG. 12 depicts a further example of a fixed axle 52 being utilized, showing that both wheels 70 move when the axle is tilted to one side.

Figure 13:
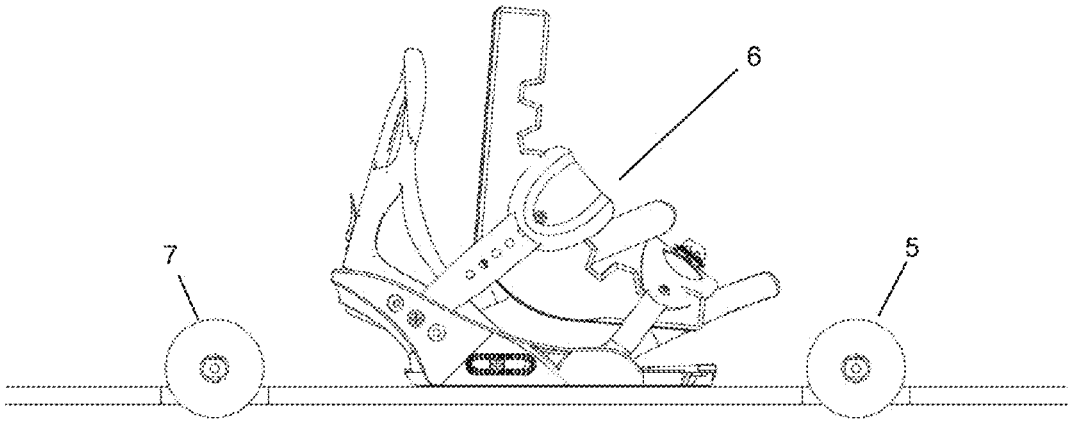
FIG. 13 depicts a side profile of a binding and fixed wheels.

FIG. 13 depicts a snowboard style binding 6, which is attached at about the center point of the ski, along the longitudinal axis, and depicting the fixed wheels 7 and 5 positioned on each side of the binding, and having wheels extending on each side along the lateral axis.

Figure 14:
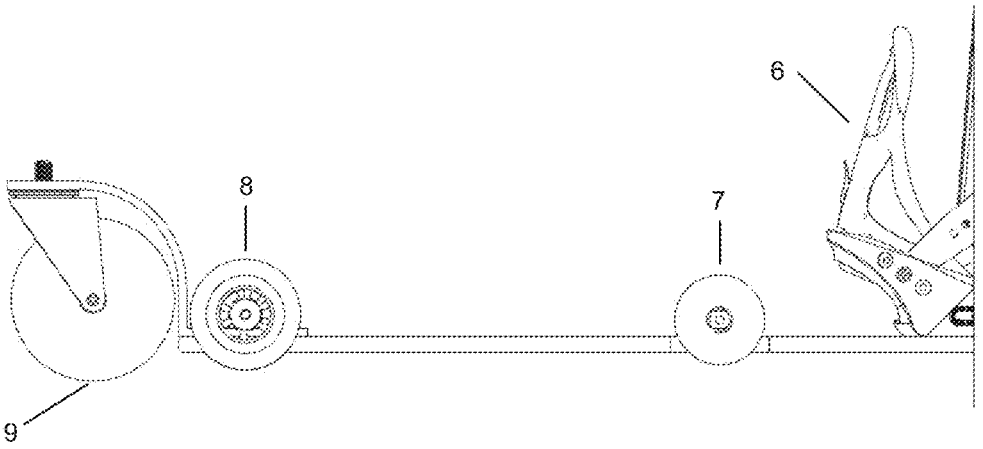
FIG. 14 depicts a side profile of the rear half of an embodiment of a ski.

FIG. 14 further depicts a depiction of the rear half of a summer ski, depicting the rear caster 9, the rear wheels 8, and the rear fixed wheels 7. As can be seen in the Figure, the caster wheel 9 is the largest wheel and also has the greatest distance from the bottom of the wheel to the bottom of the base. The adjustable wheel 8 has the next greatest distance between the bottom of the wheel and the bottom of the base, and the fixed wheel 7 has the least amount of distance between the bottom of the wheel and the bottom of the base. This causes the wheels to engage only where a force is applied that is sufficient to flex the base 4 and to thus engage the other sets of wheels.

Further bindings are contemplated being a hybrid style binding using both a winter ski style binding and a snowboard style binding. The typical winter ski style binding comprises a firm boot that secures to a toe clip and a heel clip. Whereas the snowboard style binding typically uses a more flexible boot and a compression plate over the front of the foot to secure the foot and boot to a sole plate and heel plate attached to the base of the ski or board. A hybrid binding/attachment system would incorporate a variable stiffness tongue from a ski boot with a compression plate from the snowboard binding. The goal is to allow a user to wear regular athletic footwear with easy entry/exit, while maintaining the stiffness of a traditional ski binding. Other suitable bindings may include a downhill ski binding, a slalom binding, a cross-country ski binding, or a snowboard binding.

Although the present invention has been described in considerable detail, those skilled in the art will appreciate that numerous changes and modifications may be made to the embodiments and preferred embodiments of the invention and that such changes and modifications may be made without departing from the spirit of the invention. It is therefore intended that the appended claims cover all equivalent variations as fall within the scope of the invention.

What is claimed is:

1. A wheeled ski comprising a base, a binding, and three different wheel types, arranged along the length of the ski:

a. Wherein the base is a flexible member having a length, a width, and edges, with the length being several times greater than the width;

b. wherein the binding is centrally located along the longitudinal axis of the base, and the three wheel types have a having a mirror image wheel type on either side of the binding;

c. wherein extending away from the binding along the longitudinal axis in each direction is a pair of fixed wheels having a fixed axle mounted to the base, and the wheels, mounted on said axle and extending away from the base along the lateral direction, where the wheels can rotate along a rotational axis and allow the ski to move along the longitudinal axis;

d. extending further to the end of the ski from the fixed wheels are corresponding pairs of moveable axle wheels, having a binding with an axle positioned along the lateral axis and wherein the axle can move horizontally; and e. wherein, the outermost wheels are single caster wheels positioned at each end of the ski, and mounted on a Z-shaped mount.

2. The ski of claim 1, wherein the binding uses a toe clip and a heel clip to secure a boot to the binding.

3. The ski of claim 1, wherein the fixed wheels are positioned within a cutout portion of the base, whereby a portion of the wheel is positioned within the cutout portion and a portion of the wheel extends beyond the edge of the base.

4. The ski of claim 1, wherein the moveable wheels extend beyond the edge of the base.

5. A wheeled ski comprising a base, a binding, a pair of caster wheels, two pairs of moveable axle wheels, and two pairs of fixed axle wheels each arranged along the longitudinal axis of the base;

a. wherein the base has a length, a width, a left edge, a right edge, a top, a bottom, a front and rear tip, and two cutout portions;

b. wherein connected to each of the front and rear tip is a caster support member having a Z shape, wherein one side of the Z shaped member is connected to a portion of the top of the base at the front and rear tips, and the other end of the Z shaped member is positioned above the base and extends past the tip to be about parallel to the base; the end extending past the tip comprises a pivot member and attached to the pivot member is a caster and attached wheel, which is positioned on the underside of the end of the Z shaped member extending past the tip;

c. adjacent to the Z shaped member and positioned towards the center of the base along the longitudinal axis on each end, is a pair of adjustable axle wheels; wherein the adjustable axle is connected to a mount which is connected to the base and the axle extending along the lateral axis; wherein wheels are attached to each side of the axle and extend beyond the left and right edges of the base;

d. positioned within the two cutout portions of the base are two pairs of fixed axle wheels, wherein the fixed axle is secured to the base and positioned such that the axle is along the lateral axis and parallel to the adjustable axles; wherein the wheels are engaged to the axle and a portion of the wheel extends past the edges of the base;

e. about centrally positioned on the base, and between the fixed axle wheels, is a binding; and f. wherein the three different types of wheels have varying vertical clearance with respect to the bottom base; wherein the fixed wheels have the smallest clearance between the bottom of the wheel and the bottom of the base; the adjustable wheels having the next smallest clearance; and the caster wheels on each end having the greatest distance between the bottom of the wheel and the bottom of the base; whereby when the ski is placed on a surface, only the caster wheels are therefore necessarily touching the surface.

6. The ski of claim 5, wherein the lateral distance of the wheels is measured from the center line of the base, with the caster wheel being positioned along the center line, the fixed axle wheels extending to no more than about one half of the width of the wheel past the edge, and the movable axle wheels extending more than one half of the wheel width past the edge.

7. The ski of claim 5, wherein the movable axle is a skateboard style axle, having a fixed axle that can pivot on a central grommet.

8. The ski of claim 5, wherein the movable axle is an independent suspension axle.

9. The ski of claim 5, wherein the fixed axle wheels extend past the side of the base by no more than one-half of the width of the wheel.

10. A wheeled ski comprising three sets of wheels, a binding, and a base; wherein the first type of wheel is a freely rotating wheel; with one freely rotating wheel attached to a support member at each end of the longitudinal axis of the base; attached adjacent to the freely rotating wheels on each end are a pair of movable axle wheels, wherein the axle is oriented along the lateral axis and having a rotational axis such that the wheel attached to the axle will move the ski along the longitudinal axis; attached between the pair of movable axle wheels on each end is a pair of fixed axle wheels, with the axle aligned along the lateral axis and parallel to the other axles; and centrally located is a binding that is situated between the two pairs of fixed axle wheels;

wherein each of the three types of wheels has a different amount of clearance from the bottom of the wheel to the bottom of the base, wherein the freely rotating wheel has the greatest clearance, the movable axle wheels the next greatest clearance, and the fixed axle wheels the least clearance; and wherein each wheel has a different lateral distance from a center line of the base, with the freely rotating wheel being along the center line, the fixed axle wheels extending to no more than one half of the width of the wheel past the edge, and the movable axle wheels extending more than one half of the width of the wheel beyond the edge.

11. The ski of claim 10, wherein the movable axle is a skateboard style axle, having a fixed axle that can pivot on a central grommet.

12. The ski of claim 10, wherein the movable axle is an independent suspension axle.

13. The ski of claim 10, wherein the fixed axle wheels are positioned within a cutout of the base.

14. The ski of claim 10, wherein upon application of a force to the top of the ski, the base flexes and the movable axle wheels engage with the ground.

15. The ski of claim 10, wherein upon application of a force to the tip of the ski, the base flexes and the fixed axle wheels engage with the ground.

16. The ski of claim 10, wherein the binding comprises a toe clip.

17. The ski of claim 10, wherein the binding is selected from the group consisting of: a downhill ski binding, a slalom binding, a cross-country ski binding, or a snowboard binding.

* * * * *